US007971712B2

(12) United States Patent
Talwar et al.

(10) Patent No.: US 7,971,712 B2
(45) Date of Patent: Jul. 5, 2011

(54) PORTABLE CASING AND METHOD FOR CARRYING INSTRUMENT

(76) Inventors: Vijay Kumar Talwar, Kolkata (IN); Renu Talwar, Kolkata (IN); Pooja Talwar, Kolkata (IN)

( * ) Notice: Subject to any disclaimer, the term of this patent is extended or adjusted under 35 U.S.C. 154(b) by 489 days.

(21) Appl. No.: 11/965,991

(22) Filed: Dec. 28, 2007

(65) Prior Publication Data

US 2008/0156678 A1 Jul. 3, 2008

(30) Foreign Application Priority Data

Jan. 3, 2007 (IN) ..... 16/KOL/2007

(51) Int. Cl.
*A45C 11/00* (2006.01)

(52) U.S. Cl. ..... 206/314; 206/523; 206/592; 84/385 A

(58) Field of Classification Search ..... 206/14, 206/314, 493, 521, 523, 583, 588, 592; 84/380 R, 84/385 A, 385 R, 385 P, 387 R
See application file for complete search history.

(56) References Cited

U.S. PATENT DOCUMENTS 1,664,476 A * 4/1928 Geib ..... 206/314
1,888,927 A * 11/1932 Lang ..... 206/314
1,900,718 A * 3/1933 Lang ..... 206/314
1,988,718 A * 1/1935 Cook et al. ..... 206/314
2,792,932 A * 5/1957 Freistat ..... 206/314
3,048,262 A * 8/1962 Pascucci ..... 206/314
3,326,359 A * 6/1967 Katz ..... 206/314
4,427,113 A * 1/1984 Wanner ..... 206/314
6,334,534 B1 * 1/2002 Hollingsworth et al. ..... 206/320
6,384,309 B1 * 5/2002 Lellingson ..... 206/314
6,945,396 B2 * 9/2005 Dimbath ..... 206/314

* cited by examiner

*Primary Examiner* — Luan K Bui
(74) *Attorney, Agent, or Firm* — Pearl Cohen Zedek Latzer, LLP

(57) ABSTRACT

The present invention provides a portable casing for carrying instrument, particularly musical instrument, very securely. The casing interior is provided with flexible shock absorbing support(s) on which the non-vulnerable portions of the instrument are laid whereas the delicate and vulnerable portions are held suspended in mid-air. As soon as the casing is closed, the supports get deformed acquiring a loop-shaped structure to encircle and cradle the instrument-parts which overlie thereon and in doing so the instrument is rendered securely captive against any movement In case of accidental impact the stress generated is borne by the soft lining of the casing and by the shock absorbing supports, rendering the instrument unharmed. The shock absorbing supports are advantageously detachably secured to the inner walls of the casing by retaining means. The present invention also provides a method for housing instrument in a portable casing for transportation.

13 Claims, 3 Drawing Sheets

PORTABLE CASING AND METHOD FOR CARRYING INSTRUMENT

FIELD OF INVENTION

The present invention relates to a portable casing and a method for carrying instrument. Although the casing is generally suitable for carrying any instrument which is prone to damage due to impact, it is particularly suitable for carrying musical instruments, of any type and shape, in a manner whereby in case of an accidental impact, detrimental effects on the vulnerable and delicate parts of the instrument are avoided or are substantially reduced.

BACKGROUND OF INVENTION

The casings that are presently being used to carry instruments, particularly musical instrument, can be broadly categorized into two types: (a) hard casings, comprising hard outer shell made of plywood, wood, or plastic and a contoured inner recess to accommodate therein instruments of matching profile, (b) bags, also known as gig bags, comprising soft outer shell made of leather or fabric.

The conventional hard casings, belonging to the first category, have contoured interior usually made up of moulded plastic or carved thermocol, confines the instrument in its place even during transportation. But such hard casings are heavy, awkward in shape and are expensive though they do provide satisfactory protection to the musical instrument housed inside. More often than not the musicians find it cumbersome to carry musical instrument in it. Moreover such casings are very much instrument-specific. A casing being used for an instrument of a particular type or make is not suited to carry instruments of varying shape and size, albeit of same genre.

The gig bag type conventional casings being made up of materials like leather or fabric are comparatively light in weight. These bags do allow instruments to be carried conveniently. But the main drawback of these bags is that in case of accidental impact they do not provide required protection to the instruments being carried. The soft outer covering and the inner lining of the bags are unable to provide adequate protection to the delicate and vulnerable portions of the instruments.

Thus, it has been noticed that the conventional casings and bags being used for carrying instruments are either heavy, awkward in shape and expensive or they are unable to provide adequate protection to the instrument, particularly to its delicate parts, against damage in case of accidental impact.

It is also known to locate the ends of fragile or delicate objects like television and glass tubes in recessed supports made of light material like thermocol or Styrofoam so that objects in most parts are in air. The objects fitted with such recessed end supports are inserted in packaging, generally corrugated cardboard boxes, for the purpose of transportation. The idea behind such packaging of the fragile objects is to ensure that during transport any physical impact on the outer-box does not get transmitted to the objects themselves. However, such packaging concept or procedure is not relevant to the present invention, because it is unsuitable for adoption to carry instruments that require frequent taking out and stowing back.

An object of the present invention is to provide a portable casing for carrying instruments, in which instruments can be carried conveniently and also to provide substantial protection to the instrument against accidental damage, particularly to its delicate parts by having the instrument disposed more or less in the middle of the casing in a such a manner that the delicate parts of the instruments remain suspended in mid-air.

Another object of the present invention is to ensure that the same casing can be used to accommodate, in a secured manner, instrument of varying sizes but belonging to the same class.

Yet another object of the present invention is to ensure that the foregoing objects are realized in a simple and cost-effective manner.

SUMMARY OF THE INVENTION

With the above and other objects, which will become apparent from the description that follows hereinafter, in view, the invention provides a portable casing for carrying instruments, said casing having inner walls lined with soft cushioning material, characterized in that:

- the casing interior is provided with one or more flexible shock absorbing supports on which portion(s) of the instrument is adapted to sit, whereby the remaining portion of the instrument is kept in a state of mid-air suspension,
- the or each said support being adapted to form an open or closed loop shaped structure within which the instrument is cradled and held securely captive, when the casing is closed and the instrument is in stored position.

The flexible shock absorbing support(s) act as cushions, cradling the instrument housed inside the casing. Once the casing is closed the instrument is disposed more or less in the middle of the casing and the movement of the instrument becomes arrested The casing may be a bag made having a zipper, or may comprise of a base member and a lid. In either event, the instrument can be stored in a snug fit manner and carried securely.

According to a most preferred embodiment the portions of the instrument, which overlie the support(s), comprises the regions that are least vulnerable to damage against impact; whereas the portions which are kept in a state of suspension in mid air contain the most delicate and vulnerable parts of the instrument. A person familiar with an instrument can easily identify its most and least vulnerable portions and can accordingly position the flexible shock absorbing supports within the casing. In case of accidental impact on the casing, the stress generated is borne by the flexible shock absorbing support(s) and the chances of the stress being transferred to the instrument, particularly to its delicate and vulnerable parts is greatly reduced.

While it is possible and is well within the scope of this invention to fixedly secure the flexible shock absorbing support(s) to the inner walls of the casing, it is not particularly advantageous to do so, because it inherently imposes certain constraints on the properties of the casing. Firstly, the casing then becomes to some extent instrument specific with less flexibility to take instruments of various shapes and sizes. Secondly, replacement of the supports, if and when necessary due to wear and tear, is largely reduced and is rendered cumbersome.

Preferably, therefore the flexible shock absorbing support (s) are simply laid on, without being secured to the inner walls of the casing at all, or they are detachably secured to the casing interior. In either case, the support(s) should ensure that the instrument is cradled in a snug fit manner by forming an open or closed loop around the less vulnerable portions of the instrument, when the casing is closed. A portable casing having such features is most compatible to house generic instruments of different sizes. When necessary, it is also easy to replace the supports, if they are not secured or detachably secured to the casing interior.

Most preferably each flexible shock absorbing support is detachably secured to the casing interior by retaining means. Having such an arrangement not only helps to develop a contiguous relationship between a surface of support(s) and the casing interior, but at the same time it also enables the casing to accommodate a particular type of instrument of different sizes with ease, by changing the positions of the supports within the casing. Moreover with such arrangement, worn out supports can be replaced easily.

Various simple arrangements such as hook and loop type fasteners, buckle and loop arrangements, channels and guides, can be envisaged, that may act as retaining means.

According to a preferred embodiment, said flexible shock absorbing support is in the form of a belt and comprises a soft pillow shaped elongated padded member having hook and loop type fasteners provided on one of its surface. The hook and loop type fasteners enables the surface of the support to remain in abutment relationship with the interior of the casing.

Flexibility, stress resistance and pliability are the basic properties that need to be associated with the shock absorbing support envisaged according to this invention. Materials such as foam, air-bags, synthetic or natural rubber, HDPE endow such properties to the supports and can be used in the form of a sheet to configure the cushion effect of the shock absorbing supports.

Depending on the properties of the cushioning material used for making the support, the retaining means are applied either directly on the surface of the cushioning material or on the surface of a sheath enwrapping the material. The sheathing material could be a soft material such as flannel, silk or similar other fabric type material.

In a particular embodiment, the sheath of the support is provided with retaining means such as hook and look type fasteners to keep the support in a contiguous relationship with the casing interior. The most common material used as hook and loop type fasteners is a Velcro® tape or Velcro® fabric.

The support(s) are so chosen as to capable of matching the profile of the instrument and the casing structure. This ensures that the support, the casing interior and the portion of the instrument overlying the supports form a single entity when the casing is closed. The movement of the instrument within the casing is thus arrested.

The invented portable casing, when used for storing and carrying musical instrument, may also be provided with auxiliary support(s). The nature and use of auxiliary support(s), when used, are dictated by the shape and configuration of the musical instrument to be carried. The main purpose of using auxiliary support (s) is to provide additional safety to the delicate parts of the musical instruments and to further the objective that the instrument remains stationery in stored position inside the casing. Typically for example, when the invented portable casing is particularly used for carrying a wind musical instrument such as a trumpet or cornet, having a bell-shaped mouth at one end, the auxiliary support member may take the form of a truncated cone shaped member whose base is detachably secured to the inner wall of the casing. The tapered end of the truncated cone shaped support goes into the bell of the instrument and supports the bell in a manner that the rim of the bell, also known as the bell lip, never touches the inner walls of the casing. Thus the delicate bell lip is shielded from damage. In a particular embodiment, the auxiliary support member comprises a soft cushioning material enveloped within a sheath whose base is provided with retaining means consisting of hook and loop type fasteners.

According to a most preferred embodiment the invented casing is a bag provided with two flexible supports and an auxiliary support in the form of a truncated cone used for carrying musical instrument like trumpet.

According to another aspect of this invention, there is also provided a method for housing an instrument in a portable carrying casing comprising the steps of:

(a) placing portion(s) of an instrument on one or more flexible shock absorbing support provided in the casing interior whereby the remaining portions of the instrument remain suspended in mid-air;

(b) detachably securing each flexible shock absorbing supports to the casing interior so as to prevent it from being shifted or slided; and (c) closing the casing so that the shock absorbing support (s) beneath the portion(s) of the instrument deforms causing the instrument to be cradled in a snug fit manner and its movement is substantially arrested.

Preferably the invented method further comprises the step of identifying the region(s) of the instrument that are most and least vulnerable to damage against impact and placing on one or more flexible shock absorbing support(s) between the casing interior and the least vulnerable region(s) of the instrument so that the most vulnerable and delicate region(s) of the instrument remain in a state of mid-air suspension. This arrangement ensures that the instrument is stowed more or less in the middle of the bag so that the delicate and vulnerable parts of the instrument barely touches the inner walls of the casing. In case of accidental impact the stress generated is hardly transferred to the delicate parts of the instrument. The shock absorbing supports also shields the less vulnerable portions of the instrument from external impacts.

When the instrument to be carried takes the form of a wind instrument like a trumpet or a cornet having a bell-shaped mouth at one end; the invented method comprises the step of placing the supports above and/or below the delicate parts of the instrument, viz. the finger hook, the valves and the second slide, and the further step of inserting an auxiliary support, constructed in the form of a truncated cone, into the said bell shaped mouth, and detachably securing the base of said auxiliary support to the inner wall of the casing.

It can be easily envisaged that the features of the invention also extend to a casing comprising of two parts, namely, a lid member and a base member, each provided with one or more flexible shock absorbing supports. The supports are so fabricated that on closure of the casing each support of the lid member forms a loop with its counterpart disposed inside the base member. When the casing is closed, the supports provided with the lid and the base engage with each other so that the instrument housed inside the casing becomes confined. The supports entrap the least vulnerable portions of the instrument whereby the vulnerable parts remain suspended in mid-air.

BRIEF DESCRIPTION OF THE DRAWINGS

For better understanding an illustrative embodiment of the invention will now be described with reference to the accompanying drawings. It will however be appreciated that the embodiment exemplified in the drawings is merely illustrative and not limitative to the scope of the invention, because it is quite possible, indeed often desirable, to introduce a number of variations in the particular embodiment that has been shown in the drawings depending on the shape and configuration of the instrument to be carried and the casing structure one chooses to use. In the accompanying drawings.

DETAILED DESCRIPTION OF DRAWINGS

In FIGS. 1 to 4 of the drawings, for the purpose of illustration, a wind instrument, namely a trumpet (I) and a zippered bag-type casing (C) are chosen. It will, however, be understood that carrying other types of instruments in the same or other types of casing are well within the ambit of this invention.

Referring to FIGS. 1 to 4 of the drawings, the inner walls of the casing (C) are lined with a soft cushioning material (1). The casing interior is provided with flexible shock absorbing support (2). As can be seen particularly in FIG. 4, the shock absorbing supports (2), in normal condition, remains more or less flat; but being flexible in nature are capable of getting deformed so that when the casing (C) is closed with the instrument (I) kept inside it, the supports (2) acquires a loop-like shape (see FIGS. 2, &3).

Figure 1:
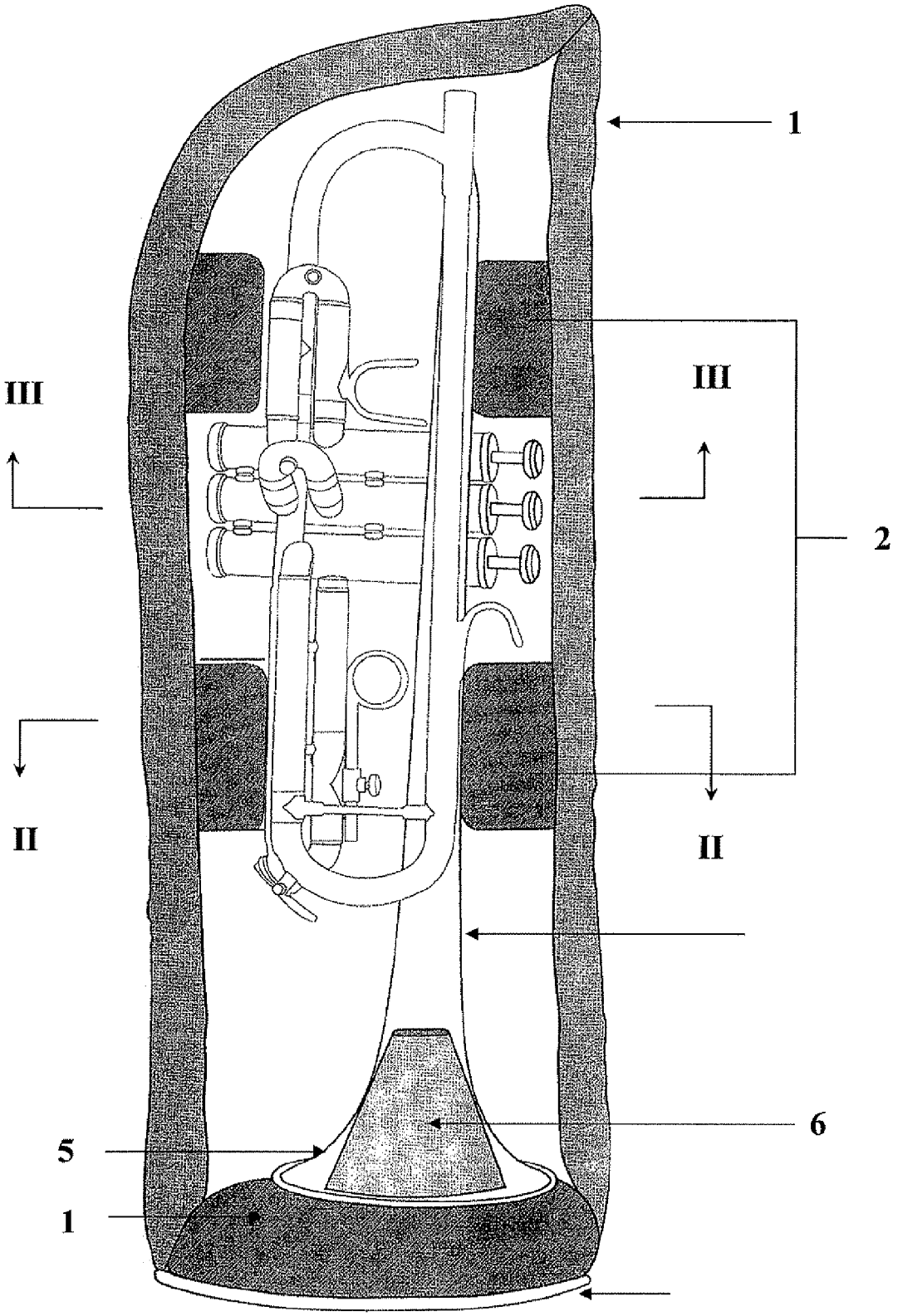
FIG. 1 is a cut away top view of the portable casing with an instrument housed inside it.
Figure 2:
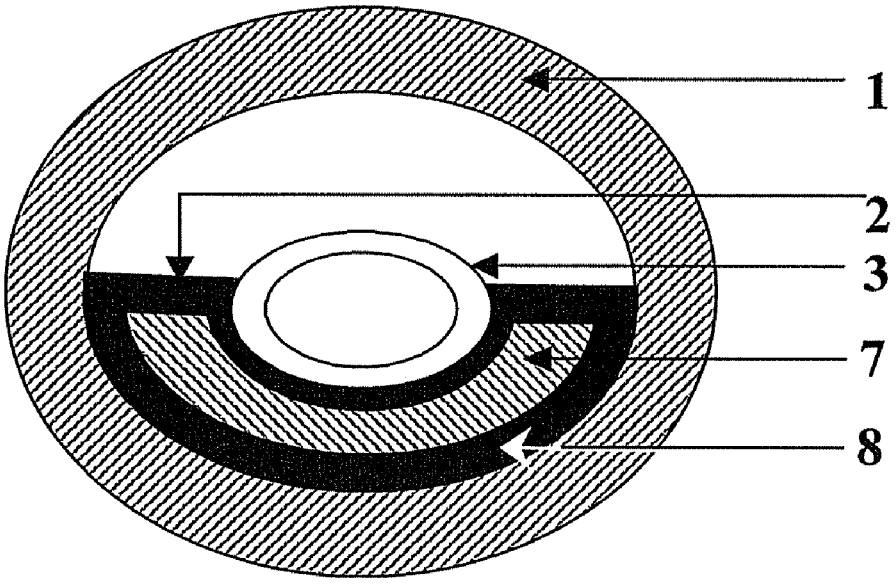
FIG. 2 is a cross-sectional view of the casing taken at line A-A in FIG. 1.
Figure 3:
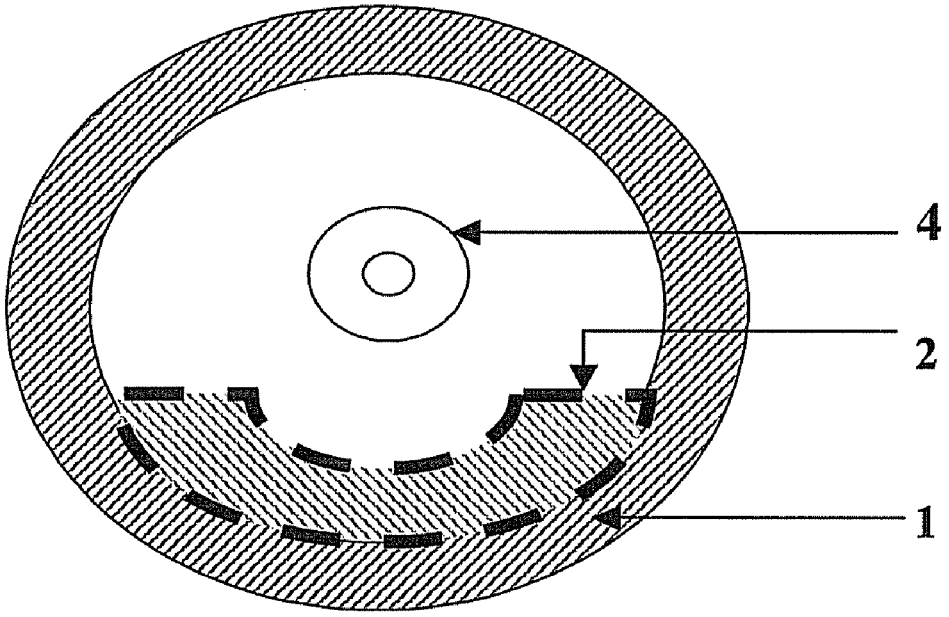
FIG. 3 is a cross-sectional view of the casing taken at line B-B in FIG. 1.

The supports (2) are laid inside the casing at those places where they {i.e. supports (2)} would underlie those parts of the instrument (I), which are substantially less vulnerable to damage against impact. It is easy for any person familiar with a particular instrument to identify which parts thereof are delicate and most vulnerable or prone to damage against impact, and which parts are less so. There should therefore be no particular problem in identifying the location(s) where the support(s) should be placed vis-á-vis the instrument desired to be carried. Once the support(s)(2) are placed at the appropriate locations inside the casing (C), the instrument (I) is disposed more or less in the middle of the casing (C)and the casing (C) is closed. As soon as the casing (C) is closed, the supports (2) get deformed acquiring a loop-shaped structure (as shown in FIGS. 2, & 3) to encircle and cradle the instrument-parts which overlie thereon and in doing so the instrument is rendered securely captive against any movement (FIG. 2). It will be understood that the placing of the supports (2) beneath certain parts {i.e. non-vulnerable parts (3)} of the instruments (I) ensures that the remaining parts {containing mainly the delicate and vulnerable parts (4)} of the instrument are held suspended in mid-air (FIG. 3) and at a safe distance from the casing interior.

Figure 4:
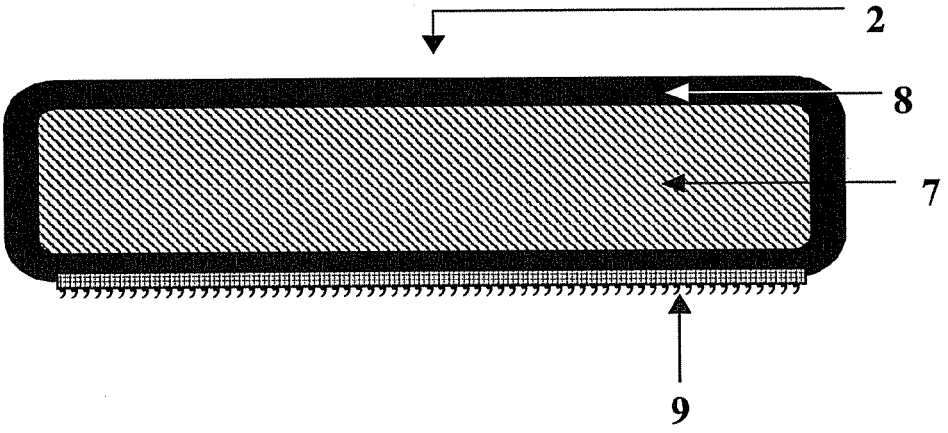
FIG. 4 is a cross sectional view of a flexible shock absorbing support member.

Generally, the support (2) takes the form of a belt like elongated pad as shown in FIG. 4.

The supports (2) may either be fixedly secured, or loosely laid, or detachably secured to the interior of the casing It will however be understood that if the supports (2) are fixedly secured e.g. by being sewed onto the casing interior, then the casing would be able to carry an instrument of one type and single size. Moreover, it becomes cumbersome to replace worn out supports, when secured fixedly to the casing. If the supports (2) are laid loosely, there is no particular harm, except that it is associated with the disadvantage that each time the instrument (I) is stowed back in the casing (C), one may need to adjust the position of the supports (2) in order to ensure that they are, by and large, kept below the substantially non-vulnerable parts of the instrument. Therefore, providing the support(s) detachably secured to the casing is by far the most preferred option.

There is available various simple forms of retaining means to secure the supports (2) detachably to the interior of the casing (C). One of the simplest and most effective form of retaining means for achieving this is to use hook and loop type fastener tape (commercially known as Velcro® tape). As shown in FIG. 4, the flexible shock absorbing support (2) may comprise a sheet (7) of pliable cushioning material; such as foam or HDPE enwrapped inside a fabric sheath (8). One surface of the sheath (8) may be provided with a hook and loop fastener tape (9) which is adapted to get secured to the cushioning material (1) of the casing interior. When required, the support (2) may be pulled free off the casing interior by tugging at the sheath (8).

Depending on the nature of the instrument, it is proposed to use auxiliary support(s), which would assist in arresting the movement of the instrument further and would also enhance the impact resistance capability of the casing. In the particular embodiment, being exemplified herein, where the instrument illustrated is a trumpet or like wind instrument having a bell-shaped mouth (5), it is preferred to use an auxiliary support (6) comprising a truncated cone shaped member whose base is detachably secures to inner wall of casing so that the tapered end goes into and supports the bell of the instrument. The auxiliary support (6) prevents the delicate rim of the bell from touching the bag wall and thus shields it from damage.

Figure 5:
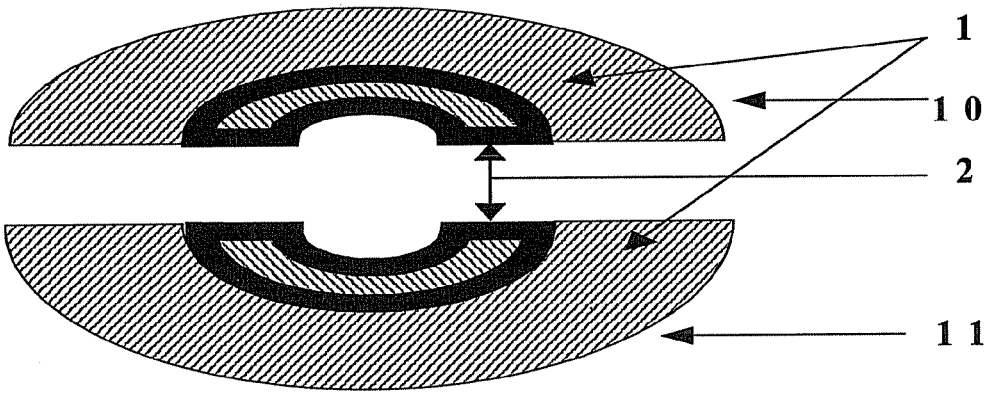
FIG. 5 is a cross sectional view of another embodiment of the casing having a base member and a lid.

In another embodiment shown in FIG. 5 the casing comprises a lid member (10) and a base member (11). The inner walls of both the lid member (10) and the base member (11) are lined with a soft cushioning material (1). The casing comprises one or more shock absorbing supports (2) depending on the instrument to be carried. The supports (2) are so fabricated that, on closing the casing, each support of the lid member (10) forms a loop with its counterpart disposed inside the base member (11). The supports (2) are preferably provided at locations where non-vulnerable parts (3) of the instrument (I) would be disposed, when the instrument is laid inside the casing (C). Once the casing (C) is closed, the non-vulnerable parts (3) of the instrument (I) rest on and snuggle within the loop formed by supports (2) thereby keeping the instrument immovably confined in its place and at the same time, the vulnerable parts of the instrument are held in a state of mid-air suspension.

It is found that the portable casing (C) of this invention carries instrument (I), particularly but not exclusively, musical instrument, very securely and is capable of withstanding any accidental impact. The stress generated by such impacts is fully borne by the soft lining of the casing and shock absorbing supports and the vulnerable parts (4) of instruments, which are in a state of mid-air suspension, are not subjected to any harm. It will be understood that the concept underlying the invention being simple, it is quite possible to achieve the objectives of the invention in various ways other than the specific means and embodiments described heretofore without departing from the scope and spirit of the invention.

The invention claimed is:

1. A portable casing for carrying an instrument, said casing having inner walls lined with soft cushioning material defining an interior thereof, wherein:

the interior of the casing is provided with one or more flexible shock absorbing supports on which at least a portion of the instrument is adapted to sit, whereby the remaining portion of the instrument is kept in a state of mid-air suspension, each said support being adapted to form an open or closed loop shaped structure within which the instrument is cradled and held securely captive, when the casing is closed and the instrument is in stored position, wherein the shape and size of each support is evolved corresponding to those of the profile of the instrument and the casing structure, wherein said musical instrument is a wind instrument like a trumpet, cornet having a bell-shaped mouth at one end which is adapted to be secured by means of an auxiliary support member, wherein said auxiliary support member comprises a truncated cone shaped member whose base is detachably secured to an inner wall of the casing and whose tapered end goes into and supports the bell of the instrument, and a soft cushioning material enveloped within a sheath which is detachably secured to inner wall of the casing by being provided therewith retaining means consisting of hook and loop type fasteners.

2. A portable casing as claimed in claim 1, wherein the portion which is adapted to sit on the flexible shock absorbing support defines regions of the instrument that are least vulnerable to damage against impact; whereas the portion which is kept in a state of mid-air suspension contains the most delicate parts of the instrument.

3. A portable casing as claimed in claim 2, wherein each said support is prevented from being shifted or slided by being detachably secured to the casing interior.

4. A portable casing as claimed in claim 3, wherein each said support is detachably secured to the casing interior by retaining means.

5. A portable casing as claimed in claim 4, wherein said retaining means comprises hook and loop type fasteners provided on the surface of the support which is in contiguous relationship with the casing interior.

6. A portable casing as claimed in claim 1, wherein each said flexible shock absorbing support is configured in the form of a belt and comprises a soft pillow shaped elongated padded member having hook and loop type fasteners provided on one of its surface which is adapted to abut against the casing interior.

7. A portable casing as claimed in claim 6, wherein said flexible shock absorbing support comprises a sheet of pliable cushioning material.

8. A portable casing as claimed in claim 7, wherein said sheet of pliable cushioning material is enwrapped in a sheath which is detachably secured to the casing interior by retaining means comprising said hook and loop type fasteners.

9. A portable casing as claimed in claim 1, wherein said casing is for carrying a musical instrument.

10. A portable casing as claimed in claim 1, wherein the casing comprises a lid and a base, each provided with one or more flexible shock absorbing supports detachably secured to the interior walls.

11. A portable casing as claimed in claim 10, wherein the supports take the form of belts or pillows which are so fabricated that on closing the casing each belt of the lid member forms a loop with its counterpart of the base member.

12. The portable casing as claimed in claim 7, wherein said sheet of pliable cushioning material comprises foam, airbags, synthetic or natural rubber, or HDPE.

13. A portable casing for carrying a wind musical instrument such as a trumpet or cornet having a bell-shaped mouth at one end, said casing being in the form of a bag having inner walls lined with soft cushioning material defining an interior thereof, wherein:

the interior of the casing is provided with two flexible shock absorbing supports on which at least a portion of the instrument is adapted to sit, whereby the remaining portion of the instrument is kept in a state of mid-air suspension;

each said support being adapted to form an open or closed loop shaped structure within which the instrument is cradled and held securely captive, when the casing is closed and the instrument is in stored position, wherein the shape and size of each support is evolved corresponding to those of the profile of the instrument and the casing structure; and the interior of the casing is provided with an auxiliary support in the form of a truncated cone to support the bell portion of the instrument thereby preventing the rim of the bell from touching the bag wall and shielding it from damage, wherein said auxiliary support member comprises a truncated cone shaped member whose base is detachably secured to an inner wall of the casing and whose tapered end goes into and supports the bell of the instrument, and a soft cushioning material enveloped within a sheath which is detachably secured to inner wall of the casing by being provided therewith retaining means consisting of hook and loop type fasteners.

* * * * *